US006193597B1

(12) United States Patent
Choi

(10) Patent No.: US 6,193,597 B1
(45) Date of Patent: Feb. 27, 2001

(54) COIN DISCHARGING APPARATUS

(75) Inventor: Sang Kyong Choi, Kyungsangnam-Do (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/300,313

(22) Filed: Apr. 28, 1999

(30) Foreign Application Priority Data

Jun. 20, 1998 (KR) ..... 98-10763

(51) Int. Cl.[7] ..... G07D 9/04
(52) U.S. Cl. ..... 453/32; 453/41
(58) Field of Search ..... 453/20, 21, 32, 453/37, 38, 40, 41, 43

(56) References Cited

U.S. PATENT DOCUMENTS 4,436,102 * 3/1984 Kokubo et al. ..... 453/20 X

FOREIGN PATENT DOCUMENTS

2035203 * 1/1972 (DE) ..... 453/21

* cited by examiner

*Primary Examiner*—F. J. Bartuska
(74) *Attorney, Agent, or Firm*—Birch, Stewart, Kolasch & Birch, LLP

(57) ABSTRACT

A coin discharged apparatus includes a pipe assembly for holding a plurality of coins, a base plate having a discharging chute for discharging the coins from the pipe assembly, a coin counter for counting coins being discharged through the discharging chute, a motor having an output shaft for providing rotating torque, a rotatable arm engaged with the output shaft for transferring the rotating torque, a first rod engaged with the rotatable arm for actuating the coin counter, a second rod engaged with the first rod for pushing the coins from the pipe assembly into the discharging chute, an engaging coupling for engaging the first rod with the second rod, the base plate having an elongate hole for converting a rotating motion of the engaging coupling into a reciprocating motion to cause the first rod and the second rod to reciprocate, a guide plate having an opening corresponding with the discharging chute for discharging coins and having a slit communicating with the opening for providing a guiding passage for the second rod. The apparatus also includes an end portion of the first rod opposing to the coin counter, which is wider than other portions of the first rod, and a plane of the first rod opposing to the coin counter is slanted for enlarging a frictional area engageable with the coin counter.

1 Claim, 8 Drawing Sheets

COIN DISCHARGING APPARATUS

BACKGROUND OF THE INVENTION

1. Field of the Invention

The present invention relates to a coin discharging apparatus provided in a vending machine or coin exchanger for automatically discharging coins responding to a coin discharge command signal from a controller, and more particularly, to an improved coin discharging apparatus capable of enhancing operational reliability while improving productivity by simplifying a coin discharging apparatus.

2. Description of the Background Art

In general, a coin discharging apparatus is provided in an interior of a vending machine or coin exchanger, wherein coins are kept inside and a predetermined amount of coins are automatically discharged responding to the command signal from a controller when the change is to be paid to a customer or bill is to exchanged to coins.

As shown in FIGS. 1 and 2, a conventional coin discharging apparatus includes a base plate 110. As shown in the FIG. 2, the base plate 110 is a rectangular plate having two longer edges than an other two edges and provided with a coin discharging chute 112 extending downwardly from the bottom of the base plate 110.

A stand 113 is formed on a top surface of the base plate 110 by molding it in a body with the base plate 110. The stand 113 approximately rectangular shaped, and has a size covering half of the length of the base plate 110, and is provided with an opening 111 communicated with said discharging chute 112 for discharging coins. A guide recess 113*a* is extended from a portion of the opening 111 to a shorter edge than other two edges of the stand 113 opposing to the opening 111.

Four supports 114 are formed in a body as the base plate 110 by molding and are protrude from the top surface of the base plate 110 for providing a space for a guide screw 147 to move. Two supports 114 are positioned at two corners of the base plate 110 opposing to the stand 113 and each of other 2 supports 114 is positioned respectively at near the longer edges of the base plate 110. Each support 114 has a threaded recess for receiving a screw.

A supporting plate 131 is positioned on the four supports 114 and fixed by inserting screws 175 into the threaded recess. An elongate guide slot 131*a* is provided at the predetermined position of the supporting plate 131 for guiding and limiting the movement of the guide screw 147.

A bracket 132 is placed on the supporting plate 131 and fixed on the supporting plate 131 by screwing the screws 175 via supporting plate 131 into the four supports 114. The shape bracket 132 is an approximate U-shaped curved steel plate, and there is a hole on a convex top surface of the bracket 132 for accommodating an output shaft 133*a* of a motor 133. Two wings protrude from two side walls of the bracket 132 for supporting the bracket 132 and for fixing the bracket 132 by screws 175.

A motor 133 is disposed and supported on the convex top surface of the bracket 132 for providing rotating torque.

A cam 134 is connected to the output shaft 133*a* of a motor 133 by inserting the output shaft 133*a* into its central axial opening and fixing it with a screw. Under this connection, the cam 134 is rotatable in accordance with the rotation of the output shaft 133*a* of a motor 133.

A pin 135 is force fit into a through hole of the cam 134 via sleeve 136 for enhancing the engagement of pin 135 with the through hole of the cam 134. The sleeve 136 extends downwardly towards a slider body 141 and a guide hole 142 is formed on the slider body 141 for providing a contacting wall pushable by the sleeve 136. A head of the guide screw 147 is supported by the top surface of the slider body 141 and a body of the guide screw 147 passes through the slider body 141 into the elongate guide slot 131*a*. Thus, when the output shaft 133*a* of the motor 133 rotates, the sleeve l36 rotate in accordance with the rotation of the cam 134, and the rotating sleeve l36 pushes the wall of guide hole 142, so the slider body 141 moves back and forth. At that time, the guide screw 147 is guided and limited by the elongate guide slot 131*a,* so a length and track of the reciprocating slider body 141 are also guided and limited.

Slider 146 is T-shaped shape and has a stem portion extending from the edge of the slider body 141 opposing to the stand 113 towards the opening 111 of the stand 113 and a head portion crossing the edge of the slider body 141 and protruding from the edge of the slider body 141. There is a spring hole 144 on each protruded portion of the head portion respectively, for being hooked by a end of coil spring 148.

A switch actuating protrusion 145 is provided on the head portion of the slider 146 for actuating a coin counter switch 127. A cover plate 121 is disposed on the stand 113 for covering a top surface of the stand 113. The cover plate 121 has a pair of wings 121*b* extended from both longer edges of the cover plate 121 and each end of the coil springs 148 is hooked by each of recesses 121*c* of the wings 121*b*. The cover plate 121 has a hole 121*a* formed for receiving a first pipe 122 for discharging coins. A second pipe 123 is connected to pipe 122. Each 122,123 is for holding coins.

Threads are provided on a wall of the cover plate 121 forming hole 121*a* and these threads of the cover plate 121 engage with threads of the lower potion of the first pipe 122. The first pipe 122 has a slot 122*a* for receiving absence sensing switch 125. Threads are is provided on an inner wall of an upper portion of the first pipe 122 and the second pipe 123 is also provided with threads at its lower portion, so the first pipe 122 is coupled to the second pipe 123 by engaging these two threaded portions. A nut 123*a* is disposed for covering a coupled portion between the first pipe 122 and the second pipe 123.

A bracket 124 is fixed on the cover plate 121 for supporting the absence sensing switch 125. The absence sensing switch 125 has a switch arm 125*a* and a switch contact 125*b*. The switch arm 125*a* and the switch contactor 125*b* are inserted into the first pipe 122 through the slot 122*a* so that they may sense an insufficiency of coins. When there are coins more than, such as three coins, enough to exchange or pay the change in the first pipe, the coin push the switch arm 125*a* to contact with the switch contactor 125*b,* so a switch ON or OFF signal can be generated and outputted from the absence sensing switch 125.

A bracket 126 is fixed on the cover plate 121 by screws for supporting the coin counter switch 127. Screws 173 the bracket 126 on the cover plate 121 and screws 174 the coin counter switch 127 on the bracket 126.

The coin counter switch 127 includes a switch arm 127*a* and a switch contactor 127*b*.

When the slider 146 slides forth along the guide recess 113*a* for pushing a coin, the switch actuating protrusion 145 pushes the switch arm 127*a* to contact with the switch contactor 127*b*.

This operation can be easily understood by referring to the FIGS. 4A, 4B. That is, FIGS. 4A shows a state where in the slider 146 slides forth along the guide recess 113*a* for pushing a coin, and the switch actuating protrusion 145 pushes the switch arm 127*a* to contact with the switch contactor 127*b*. FIG. 4B shows a state wherein the slider 146 slides back along the guide recess 113*a,* the switch actuating protrusion 145 releases, and the switch arm 127*a* separates from the switch contactor 127*b*.

If the switch arm 127*a* contacts with the switch contactor 127*b,* the coin counter switch 127 counts a discharge of a coin and generates/outputs a signal representing a discharge of a coin.

The operation of the above mentioned conventional coin discharging apparatus will be explained with reference to FIGS. 3A, 3B as follows.

As shown in FIG. 3B, when the slider 146 moves back, a lowest coin of the coins 1 being stacked in the pipe means 120 is supported by the stand 113.

Since the opening of the first pipe 122 is deviated partially from the opening 111 of the discharging chute 112 and the stand 113, most portions of the lowest coin of the coins 1 being stacked in the pipe means 120 are placed on the stand 113 without falling through the discharging chute 112.

If there is a command signal from the controller (not shown) for paying change or exchanging bills into coin, the motor 133 rotates responding to said command signal. The rotation of the motor 133 makes the cam 134 connected to the output shaft of the motor 133 rotate, and the sleeve 136 connected to the cam 134 pushes the slider body 141 to move forth. Simultaneously with this action, the guide screw 147 moves forth in the guide slot 131*a*.

Thus the slider 146 moves forth as much as the length of the guide slot 131*a,* so the lowest coin 1 on the stand 113 is pushed by the slider 146 to drop into the discharging chute 112.

At this time, the switch actuating protrusion 145 moves forth, and actuates the coin counter switch 127. And the coin counter switch 127 generates and outputs a count signal indicating a discharge of a coin to the controller.

By the time the controller receives the corresponding count signal with a predetermined value from the coin counter switch 127, the controller outputs the command signal to the motor 133 continuously, so the slider 146 repeatedly to moves back and forth until the command signal indicates the ceasing of operation from the controller to the motor 133.

The description of the operation of the other parts except above mentioned will be omitted for avoiding repetition.

However, the conventional coin discharging apparatus has a complicated slider and also there are required many parts such as cams, pins, sleeves, brackets, etc., thereby deteriorating productivity and incurring production cost.

Further, since the reciprocal movement of the slider is restored by the tension spring, the tension of the spring is deteriorated when used for a long time period.

And the counting of coin discharging is implemented by a coin counter switch actuated by the switch actuating protrusion on the slider, and the slider is biased by two springs. So, if there is any deviation from the correct relative position between coin counter switch and switch actuating protrusion or if there is any difference of tension between the two springs, the correct counting of coin is not implemented, thereby deteriorating product reliability.

SUMMARY OF THE INVENTION

The present invention is directed to overcoming the conventional disadvantages of prior art devices.

Therefore, it is an object of the present invention to provide a coin discharge apparatus which simplifies the complicated conventional apparatus including a tension spring to a linkage arrangement, thereby improving product reliability.

To achieve the above-described object, there is provided a coin discharge apparatus according to the present invention comprising; a pipe means for holding a plurality of coins; a base plate having a discharging chute for discharging the coins from said pipe means; a coin counter for counting coins being discharged through said discharging chute; a motor having a output shaft for providing rotating torque; a rotatable arm engaged with said output shaft for transferring the rotating torque; a first rod engaged with said rotatable arm for actuating said coin counter; a second rod engaged with the first rod for pushing the coins from said pipe means into the discharging chute; an engaging means for engaging said first rod with said second rod; said base plate having a elongate hole for converting a rotating motion of the engaging means into a reciprocating motion to cause the first rod and the second rod to be reciprocated; a guide plate having an opening corresponding with said discharging chute for discharging coins and having a slit in communication with said opening for providing a guiding passage to the second rod.

The features and advantages of the present invention will become more readily apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
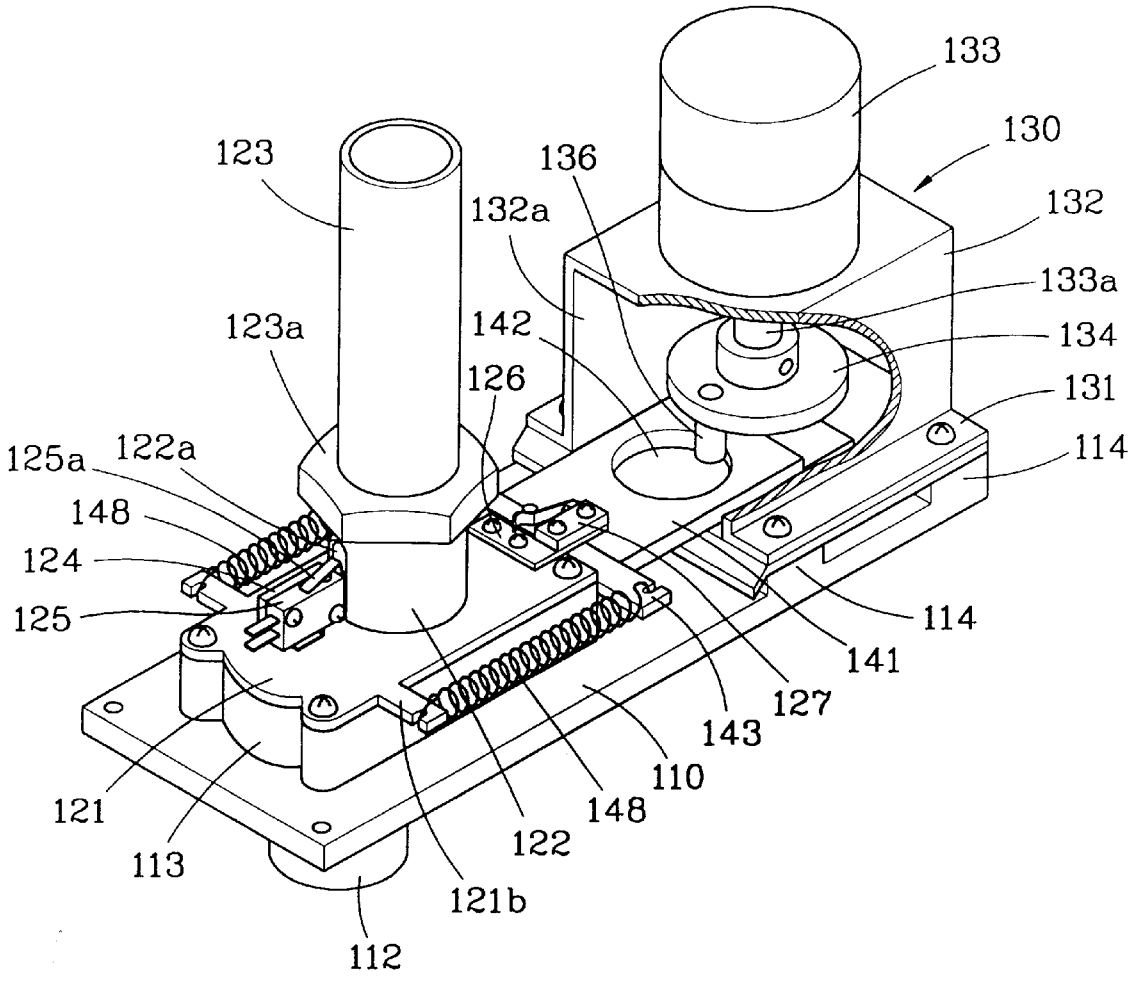
FIG. 1 (PRIOR ART)
FIG. 1 is a partially sectioned perspective view illustrating a conventional coin discharging apparatus applied to a general vending machine.
Figure 2:
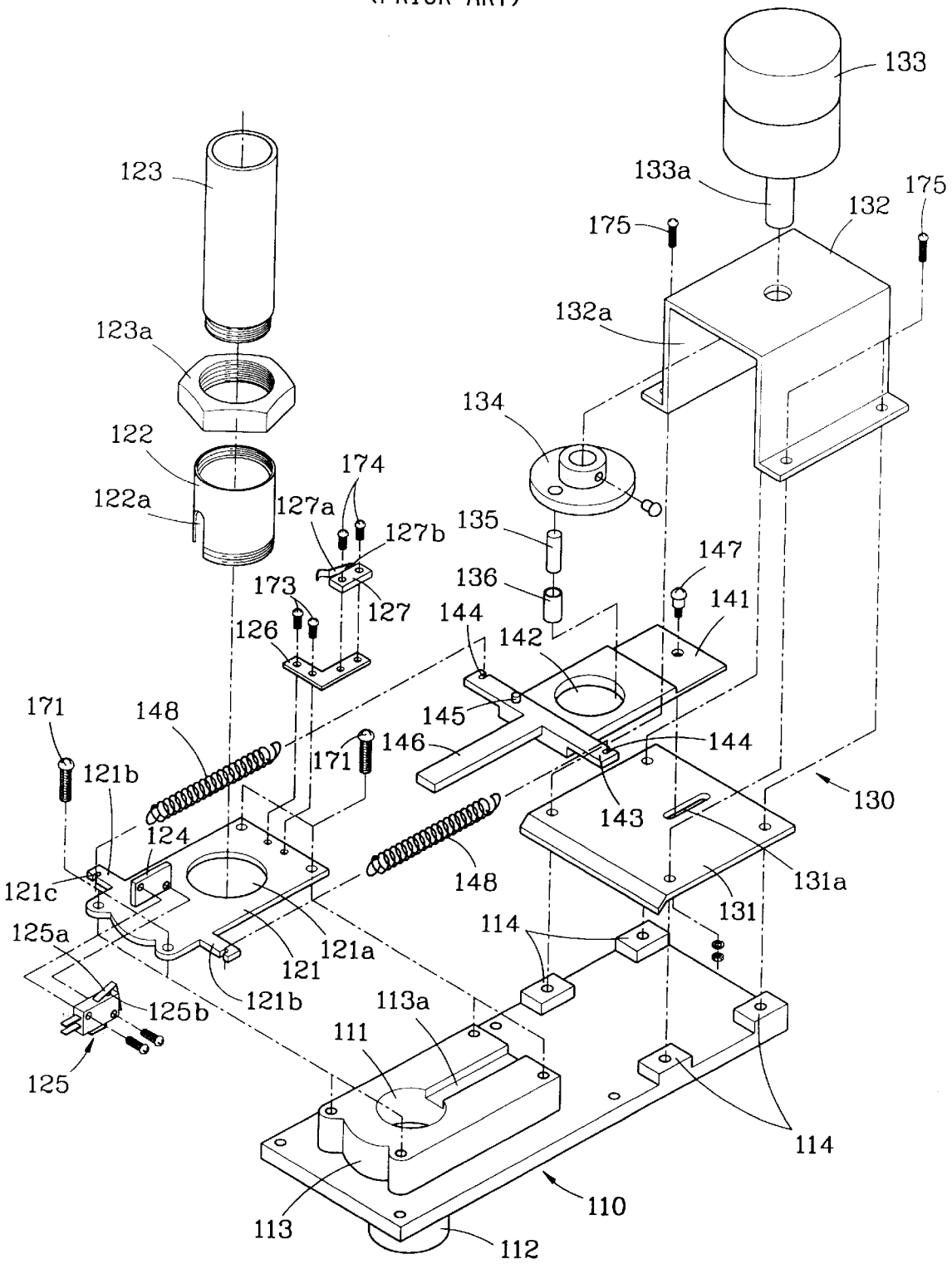
FIG. 2 (PRIOR ART)
FIG. 2 is an exploded perspective view illustrating respective parts of the conventional coin discharging apparatus.
Figure 3A:
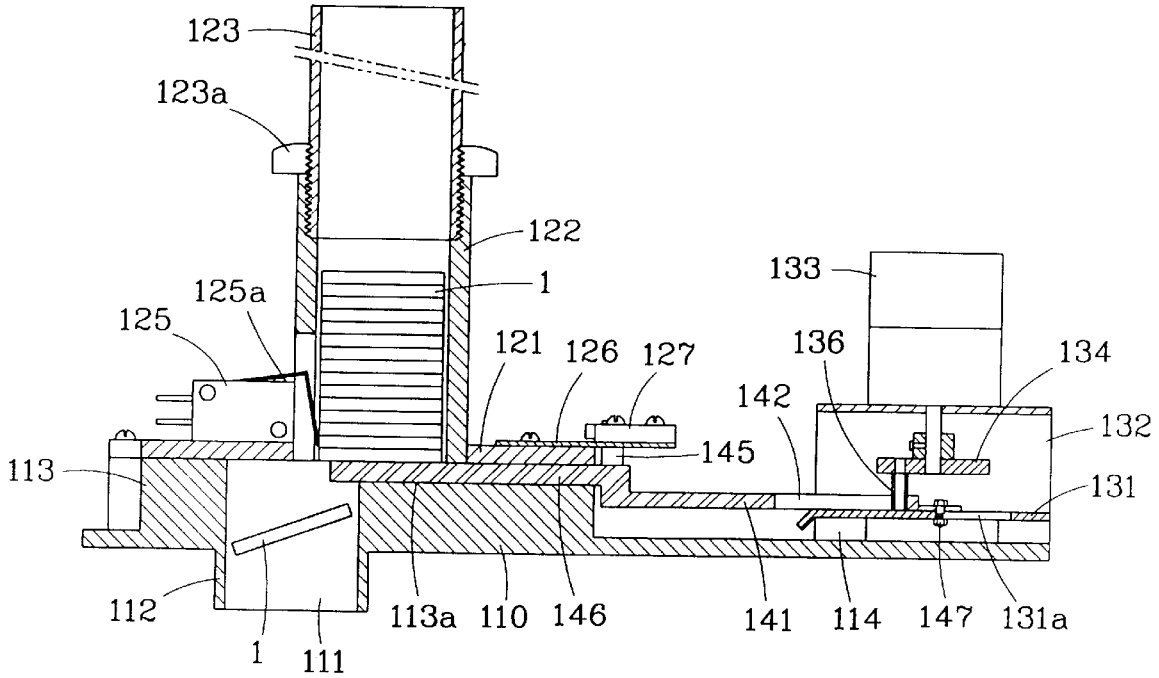
FIG. 3A (PRIOR ART)
FIG. 3A is a cross-sectional view illustrating the conventional coin discharging apparatus in which one coin is being discharged while a slider pushes the lowest coin held in a pipe means.
Figure 3B:
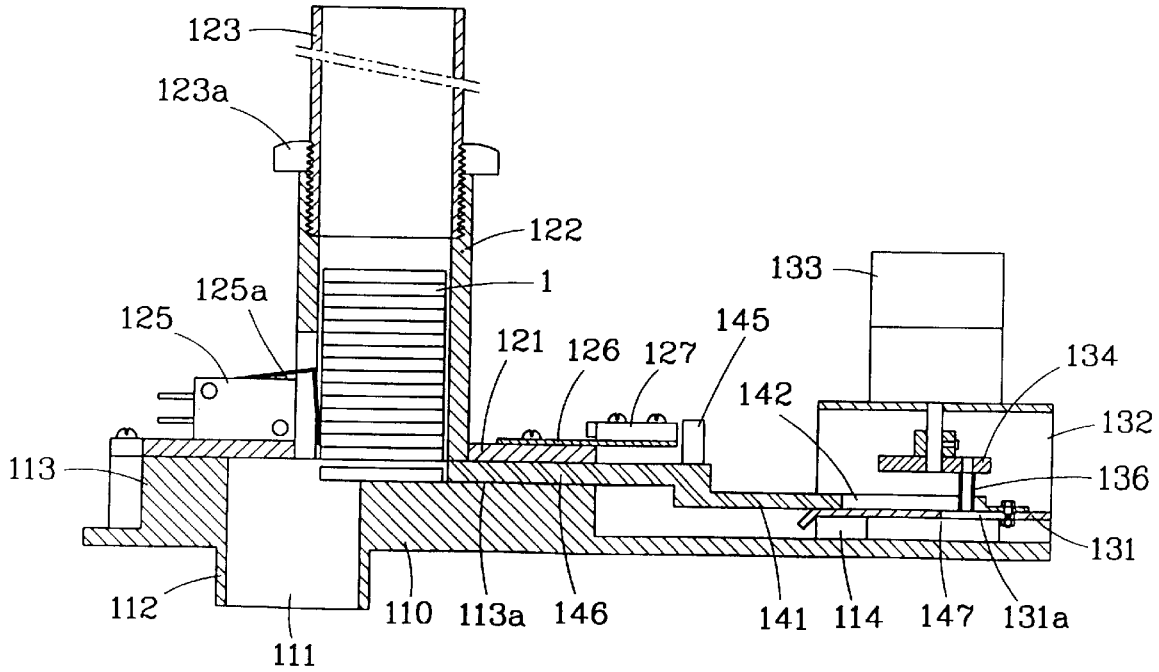
FIG. 3B (PRIOR ART)
FIG. 3B is a cross-sectional view illustrating the conventional coin discharge apparatus in which a lowest coin is placed on the stand while a slider is retracted.
Figure 4A:
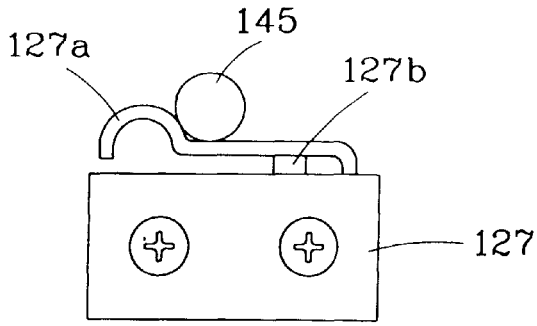
FIG. 4A (PRIOR ART)
FIG. 4A is a plan view illustrating a state in which the slider moves forth and the counter switch is de-actuated, for explaining the principle of a counter switch applied to the conventional coin discharging apparatus so as to control the number of coins being discharged.
Figure 4B:
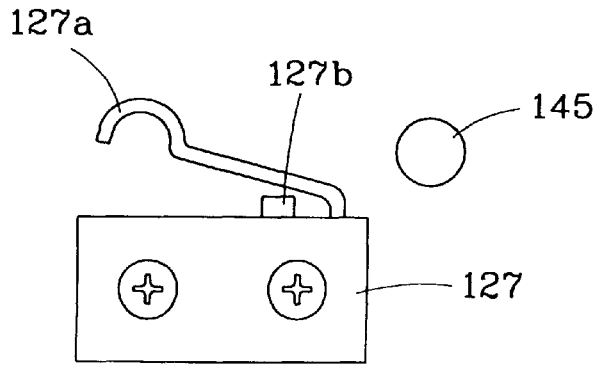
FIG. 4B (PRIOR ART)
FIG. 4B is a plan view illustrating a state in which the slider moves back and the counter switch is released by a switch actuating protrusion.
Figure 5:
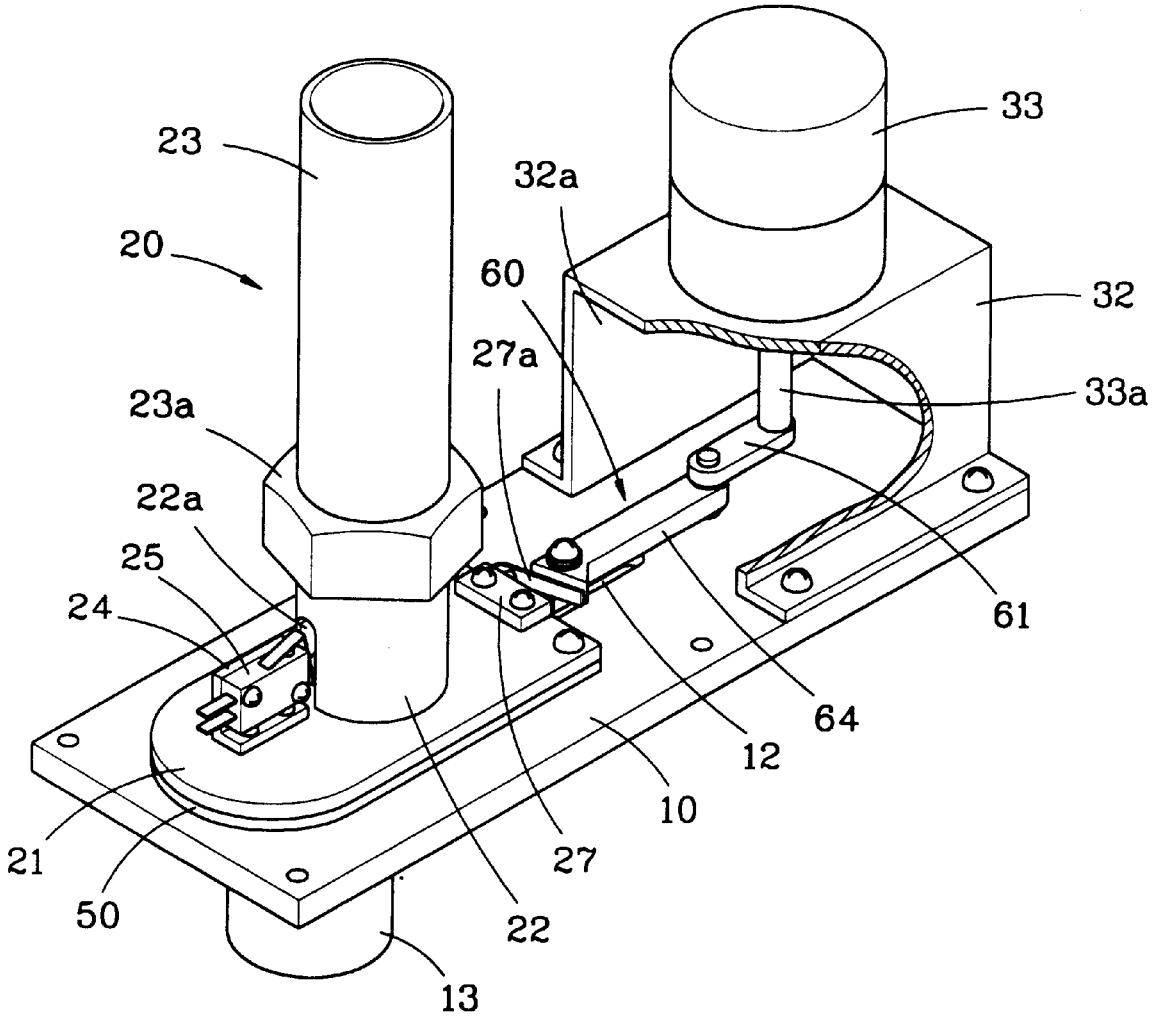
FIG. 5 is a partially sectioned perspective view illustrating a coin discharging apparatus according to the present invention.
Figure 6:
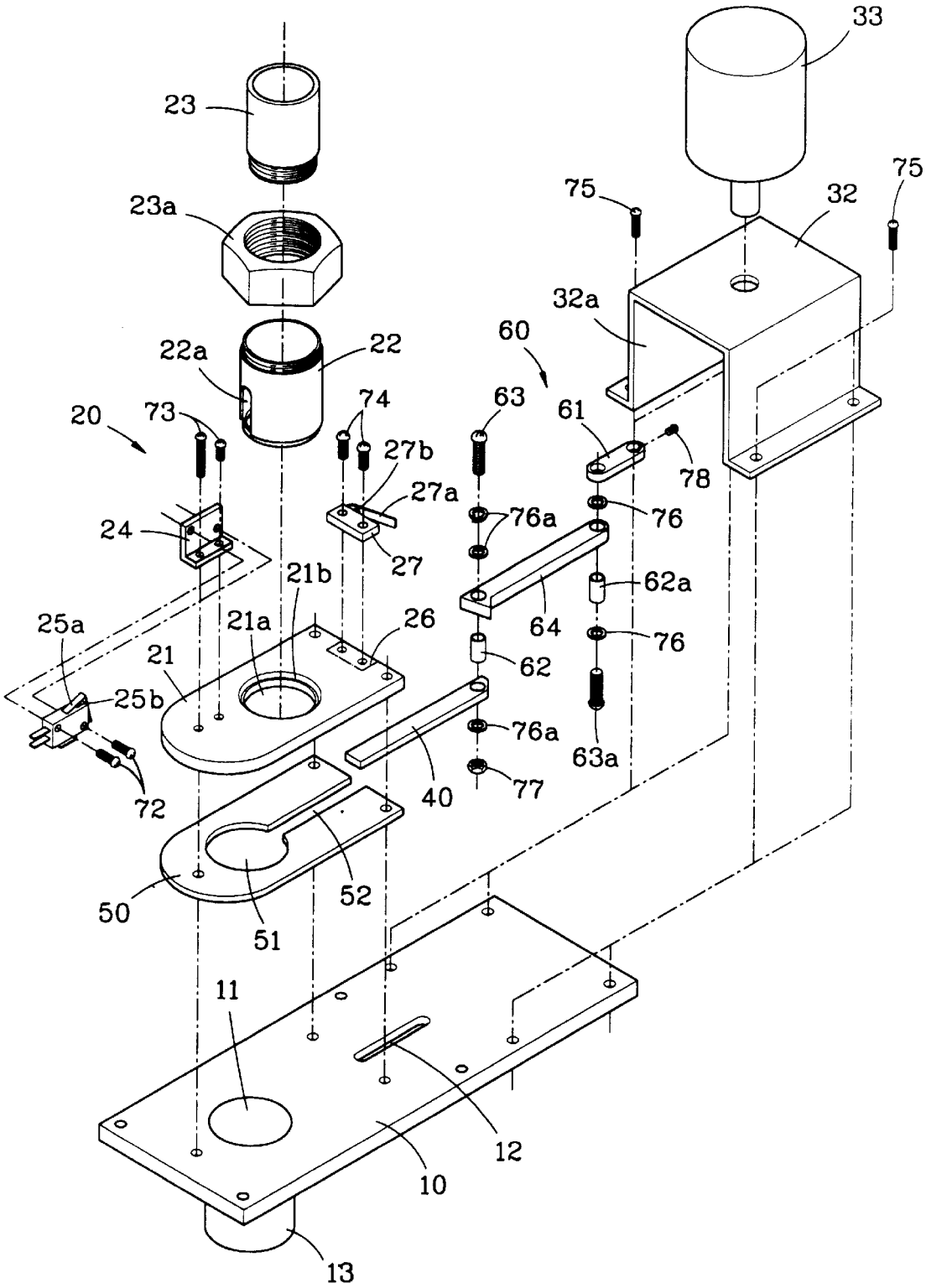
FIG. 6 is an exploded perspective view illustrating all parts of the coin discharging apparatus according to the present invention.

With reference to the accompanying drawings, the coin discharging apparatus according to the present invention will now be described. As shown in FIGS. 5 and 6, symbol 10 represents a base plate and the base plate 10 has a coin discharging chute 13 and an elongate slot 12. Symbol 10 indicates an opening 11 of the coin discharging chute 13. The base plate 10 has a approximately rectangular shape and the opening 11 is positioned with deviation at a position near a shorter edge along a longitudinal center line of the base plate 10. The elongate slot 12 is positioned at an approximate longitudinal center of the base plate 10 and lies in parallel with a longer edge of the base plate 10. The length of the elongate slot 12 is long enough for a guide screw 63 to move therein so that a second rod 40 could push a lowest coin in a first pipe 22 to fall into the opening 11.

A guide plate 50 has a circular opening 51 for discharging a coin and a elongate slit 52 communicated with the circular opening 51 for providing the second rod 40 with a passage to be movable therein. A radius of the circular opening 51 is larger than that of the opening 11 of the discharging chute 13. The guide plate 50 is positioned for most the circular opening 51 to cover the entire area of the opening 11 and the rest of the circular opening 51 over laps with the upper surface of the base plate 10 to enable the lowest coin in the first pipe 22 to be held on the upper surface of the base plate 10. The guide plate 50 is fixed on the upper surface of the base plate 10 by screws.

A cover plate 21 is placed on the guide plate 50 for covering the upper surface of the guide plate 50. The cover plate 21 has a threaded bore 21*a* for providing a coin discharging bore and for receiving a lower threaded portion of the first pipe 22. The entire portion of the bore 21 a communicates with the circular opening 51 of the guide plate 50, but only a portion of the bore 21*a* communicates with the opening 11 of the coin discharging chute 13 via the circular opening 51, so that the lowest coin in the first pipe 22 is held on the base plate 10 when it is not pushed by the second rod 40, as shown in the FIG. 7*b*. The cover plate 21 is fixed on the guide plate 50 by screws.

Symbol 24 represents a bracket for an a absence sensing switch 25 and the bracket 24 is fixed on the cover plate 21 by two screws 73. The absence sensing switch 25 is set on the bracket 24 by two screws 72. The absence sensing switch 25 has a switch arm 25*a* and a contact 25*b* which are inserted into a slot 22*a* of the first pipe 22 for sensing an absence of the coins in the first pipe 22.

A coin counter switch 27 is positioned to oppose an end of a first rod 64 and has a switch arm 27*a* and a contact 27*b* opposed to the end of the first rod 64 for counting discharging of coins.

The coin counter switch 27 is fixed on the cover plate 21 by two screws 74.

The first pipe 22 is set on the cover plate 21 by engaging its lower threaded portion with the threaded bore 21*a* of the cover plate 21 and is used for holding coins therein.

The first pipe 22 is provided with the elongate slot 22*a* for receiving the switch arm 25*a* and the contact 25*b* of the absence sensing switch 25.

A second pipe 23 for receiving coins from an upper opening is set on the first pipe 22 via an nut 23*a* for its lower opening to be communicated with the first pipe 22. The nut 23*a* couples the second pipe 23 with the first pipe 22 by engaging a upper thread portion of the first pipe 22 and the lower threaded portion of the second pipe 23 with its inner thread portion.

A motor 33 provides a driving force through its output shaft 33*a* to the apparatus according to the invention.

The output shaft 33*a* of the motor 33 is positioned towards the base plate 10 and the motor 33 is supported by a alphabet U-shaped bracket 32 with the output shaft 33*a* extended through a hole on the upper surface of the bracket 32.

The bracket 32 is arranged on the base plate 10 with its opened portion facing the base plate 10 and is fixed on the base plate 10 with its two wings screwed by four screws 75.

An end of the output shaft 33*a* is connected to one end of a rotatable arm 61 and a connection of the output shaft 33*a* and the rotatable arm 61 is maintained by screwing a screw 78 through output shaft 33*a* and the rotatable arm 61. The other end of the rotatable arm 61 is connected to first rod 64 by inserting a screw 63*a* through the first rod 64 and the other end of the rotatable arm 61.

The screw 63*a* is arranged for connecting the first rod 64 to the other end of the rotatable arm 61 with the screw 63*a* surrounded by a sleeve 62*a*.

The sleeve 62*a* may provide a smooth connection of the screw 63*a* with the first rod 64 and the other end of the rotatable arm 61.

Two washers 76 are arranged for preventing a separation of the screw 63*a* from the the first rod 64 and the other end of the rotatable arm 61.

The first rod 64 is biased to rotate responsive to the rotation of the rotatable arm 61 due to the connection of its one end with the rotatable arm 61, so the one end of the first rod 64 rotates responding to the rotation of the rotatable arm 61. However, the other end of the first rod 64 reciprocates since a guide screw 63 passing through the other end of the first rod 64 is limited to reciprocate in the elongate slot 12. Thus, the elongate slot 12 converts a rotating motion of the guide screw 63 into a reciprocating motion so that the first rod 64 may reciprocate.

Thus, when the output shaft 33*a* of the motor 33 rotates responding to a command signal from a controller not shown, the rotatable arm 61 rotates, then the other end of the first rod 64 moves forth or moves back.

If the first rod 64 moves forth, a plane of the first rod 64 opposing to the coin counter switch 27 pushes the switch arm 27*a* to contact with the contact 27*b*.

Whenever the switch arm 27*a* moves to contact with the contact 27*b*, the coin counter switch 27 outputs a count signal representing a coin discharging to the controller.

By the time the controller receives the corresponding count signal with a predetermined value from the coin counter switch 127, the controller outputs the command signal to the motor 33 continuously, so the first rod 64 repeatedly moves back and forth until the command signal indicates the ceasing of operation from the controller to the motor 33.

Figure 8A:
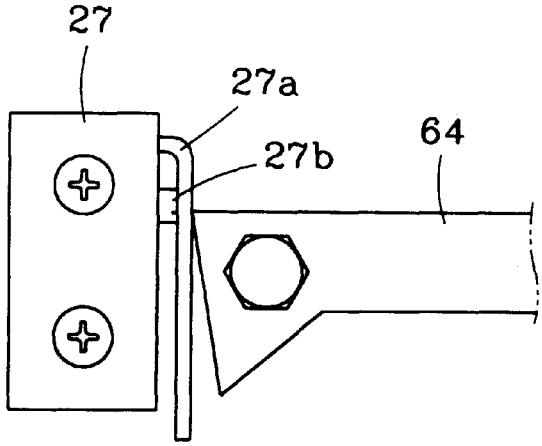
FIG. 8A is a plan view illustrating a state in which a first rod moves forth and a switch arm of the counter switch is de-actuated, for explaining the principle of a counter switch applied to the coin discharging apparatus so as to control the number of coins being discharged.

The operation of pushing the switch arm 27*a* to contact with the contact 27*b* by the first rod 64 will be described afterwards in more detail with reference to the FIGS. 8*a* and 8*b*.

The end of the first rod 64 facing the coin counter switch 127 is connected with the second rod 40. A screw 63 passes through the end of the first rod 64 and one end of the second rod 40 for engaging the first rod 64 with the second rod 40.

The sleeve 62*a* may provide a smooth connection of the screw 63*a* with the first rod 64 and the second rod 40.

Three washers 76*a* and nut 77 are arranged for preventing a separation of the screw 63 from the first rod 64 or the second rod 40. The nut 77 is engaged with the downwardly extending end of the screw 63 from the elongate slot 12 as can be seen more clearly from the FIGS. 7A and 7B.

The extending portion of the screw 63 into the elongate slot 12 is movable in the elongate slot 12 when the first rod 64 moves.

The second rod 40 is movable back or forth in accordance with the moving back or forth of the screw 63 and the first rod 64. Such a moving of the second rod 40 is guided by the elongate slit 52.

When the second rod 40 moves forth towards the circular opening 51 of the guide plate 50, the free end of the second rod 40 pushes the lowest coin in the first pipe 22 to fall into the opening 11 of the discharging chute 13. If the second rod 40 moves back towards the motor 33, the lowest coin in the first pipe 22 lies on the upper surface of the base plate 10 to wait for the next stroke of the second rod 40.

Figure 7A:
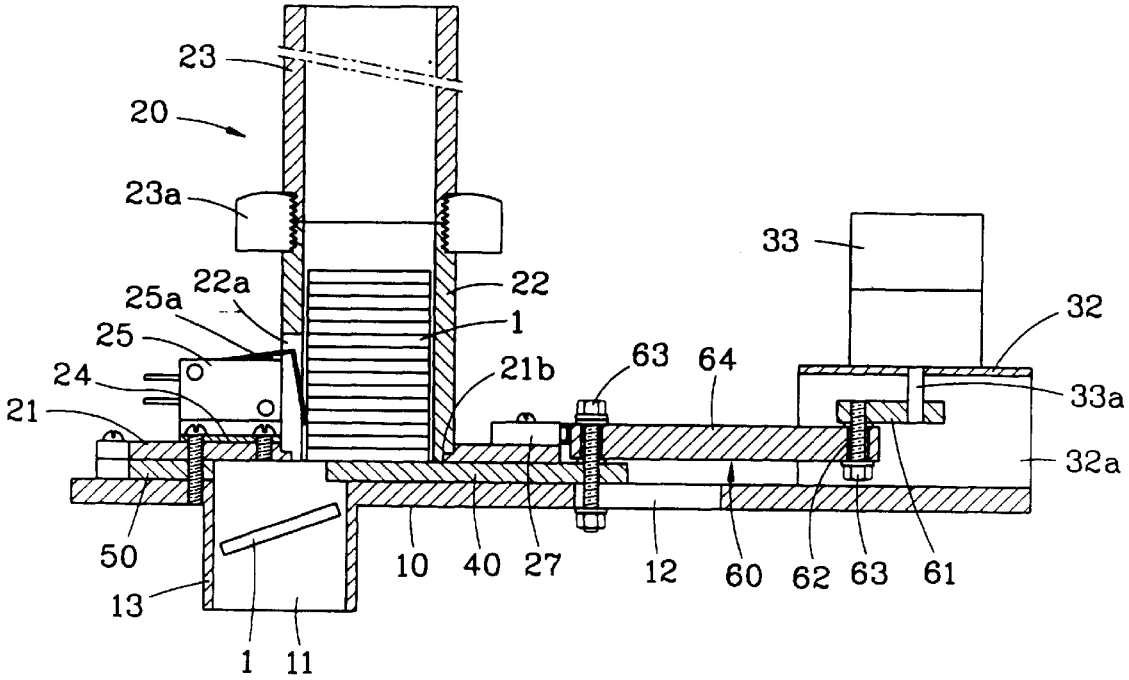
FIG. 7A is a cross-sectional view illustrating the coin discharging apparatus according to the present invention in which one coin is being discharged while a second rod pushes the lowest coin in a pipe means.

The operation of the apparatus according to the invention can be understood more a clearly by more detail description with reference to the FIGS. 7*a* and 7*b* as follows.

Figure 7B:
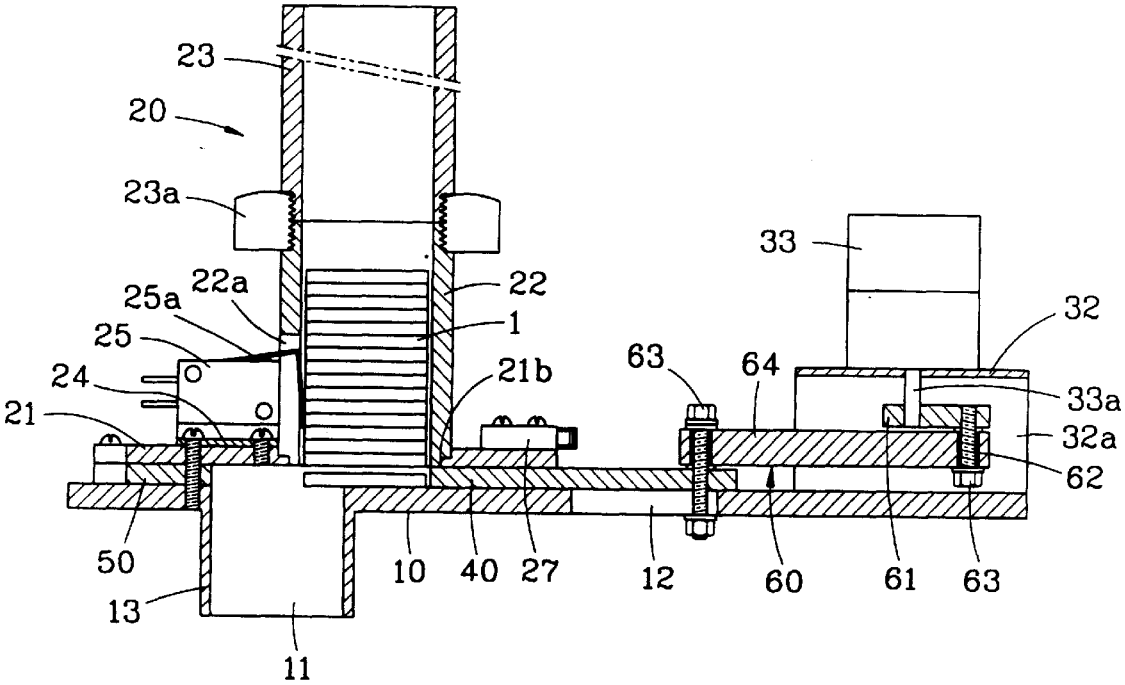
FIG. 7B is a cross-sectional view illustrating the coin discharging apparatus according to the present invention in which a second rod moves back while the lowest coin in the pipe means is placed on the base plate.

As shown in FIG. 7*b,* when the second rod 40 moves back, a lowest coin of the coins 1 being stacked in the first pipe 22 is supported by the base plate 10.

Since the opening of the first pipe 22 is deviated partially from the opening 11 of the discharging chute 13, most portions of the lowest coin of the coins 1 being stacked in the first pipe 22 are placed on the base plate 10 without falling into the discharging chute 13. When the second rod 40 moves back, the screw 63 moves back in the elongate slot 12 of the base plate 10 and the first rod 64 also moves back towards the motor 33 to separate from the coin counter switch 27.

If there is a command signal from the controller (not shown) for paying change, or exchanging bills into coins, the motor 33 rotates responding to said command signal. The rotation of the motor 133 rotates the rotatable arm 61 connected to the output shaft 33*a* of the motor 133, and the first rod 64 connected to the rotatable arm 61 is biased to rotate.

However, the guide screw 63 passing through the first rod 64 is limited to movement back or forth in the guide slot 12, so the first rod 64 moves forth towards the counter switch 27. Thus, the second rod 40 engaged with the first rod 64 by the screw 63 moves forth as much as the length of the guide slot 12, so the lowest coin 1 on the base plate 10 is pushed by the second rod 40 to drop into the discharging chute 13.

At this time, the first rod 64 moves forth, so actuates the coin counter switch 27. And the coin counter switch 27 generates and outputs a count signal indicating a discharge of a coin to the controller.

By the time the controller receives the corresponding count signal with a predetermined value from the coin counter switch 27, the controller outputs the command signal to the motor 33 continuously, so the second rod 40 repeatedly to moves back and forth until the command signal indicates the ceasing of operation from the controller to the motor 33.

The description of the operation of the other parts except above mentioned will be omitted for avoiding repetition.

The operation of actuating the switch 27 by the first rod 64 will be explained as follows in referring to the FIGS. 8*a* and 8*b*. The FIGS. 8*a* and 8*b* show the states respectively, wherein the first rod 64 pushes the switching arm 27*a* to contact with the contact 27*b* and the first rod 64 releases the switching arm 27*a* to separate from the contact 27*b*.

When the first rod 64 moves forth to push the switching arm 27*a,* the switching arm 27*a* contacts with the contact 27*b* and then coin counter switch 27 generates and outputs a count signal representing a discharge of a coin to the controller.

Figure 8B:
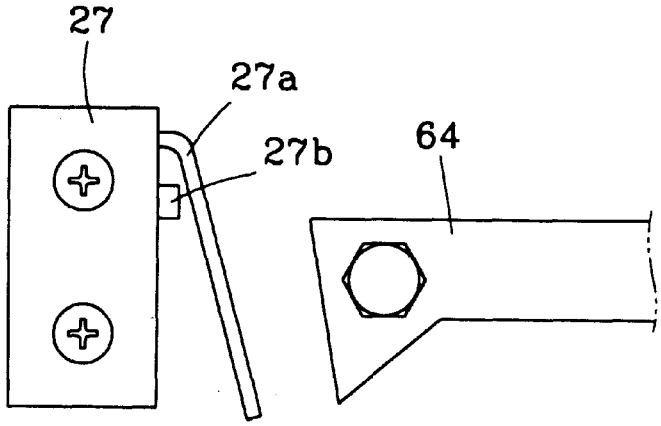
FIG. 8B is a plan view illustrating a state in which the first rod moves back and the switch arm of the counter switch is released from the first rod.

As shown on the FIG. 8*b,* when the first rod 64 moves back to release the switching arm 27*a,* the switching arm 27*a* separates from the contact 27*b* and then coin counter switch 27 stops generating the count signal.

An end portion of said first rod 64, opposing to said coin counter 27 is wider than other portion of the first rod 64 and a plane of said first rod 64 opposing to said coin counter 27 is slanted for enlarging a frictional area with said coin counter 27, especially with the switching arm 27*a*.

As described above, the coin discharge apparatus according to the present invention has a simpler structure than that of the prior art, so a production cost of the apparatus and productivity can be enhanced.

Further, the coin discharge apparatus according to the present invention does not employ a spring for restoring the position of a slider. Thus, the problem due to the tension changes of the spring can be solved. Furthermore, the coin discharge apparatus according to the present invention provides a simple means for actuating the coin counter switch, so the operation reliability of the coin counter switch can be highly improved.

As the present invention may be embodied in various forms without departing from the spirit of the essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to be embraced by the appended claims.

What is claimed is:

1. A coin discharging apparatus, comprising:

pipe means for holding a plurality of coins;

a base plate having a discharging chute for discharging the coins from said pipe means;

a motor having an output shaft for providing rotating torque;

a rotatable arm engaged with said output shaft for transferring the rotating torque;

a first rod engaged with said rotatable arm for actuating said coin counter;

a second rod engaged with the first rod for pushing the coins from said pipe means into the discharging chute;

engaging means for engaging said first rod with said second rod;

said base plate having an elongate hole for converting a rotating motion of the engaging means into a reciprocating motion to cause the first rod and the second rod to reciprocate; and a guide plate having an opening aligned with said discharging chute for discharging coins and having a slit in communication with said opening for providing a guiding passage for the second rod;

wherein an end portion of said first rod opposed to said coin counter is wider than other portions of the first rod and a plane of said first rod opposed to said coin counter is slanted for providing an enlarged frictional area for engagement with said coin counter.

* * * * *